United States Patent [19]

Fujita

[11] 3,943,697

[45] Mar. 16, 1976

[54] ELECTRONIC WATCH

[75] Inventor: Kinji Fujita, Shimosuwa, Japan

[73] Assignee: Kabushiki Kaisha Suwa Seikosha, Tokyo, Japan

[22] Filed: Aug. 30, 1974

[21] Appl. No.: 502,134

Related U.S. Application Data

[63] Continuation-in-part of Ser. No. 398,914, Sept. 24, 1973, abandoned, Continuation of Ser. No. 207,256, Dec. 13, 1971, abandoned.

[30] Foreign Application Priority Data

Dec. 14, 1970 Japan ..... 45-110795
Nov. 19, 1971 United Kingdom ..... 53891/71

[52] U.S. Cl. ..... 58/23 BA; 320/1
[51] Int. Cl.[2] ..... G04C 3/00
[58] Field of Search ..... 58/23 R, 23 BA, 50 R; 307/33, 66, 109; 320/1

[56] References Cited

UNITED STATES PATENTS

| | | | |
|---|---|---|---|
| 3,560,998 | 2/1971 | Walton | 58/23 A |
| 3,672,155 | 6/1972 | Bergey et al. | 58/50 R |

*Primary Examiner*—Edith Simmons Jackmon
*Attorney, Agent, or Firm*—Blum, Moscovitz, Friedman & Kaplan

[57] ABSTRACT

An electronic watch including an electronic divider for dividing the high frequency output signal of a standard oscillator into low frequency timing signals. The oscillator and divider are driven by a battery having a capacitor fixedly connected in parallel therewith to serve as a voltage source during temporary disconnection of the battery.

1 Claim, 3 Drawing Figures

ELECTRONIC WATCH

CROSS REFERENCE TO RELATED APPLICATIONS

This is a continuation-in-part of abandoned U.S. Application No. 398,914 filed Sept. 24, 1973, which is a continuation of abandoned U.S. Application No. 207,256 filed Dec. 13, 1971.

BACKGROUND OF THE INVENTION

This invention relates to electronic watches having a high frequency standard oscillator driving a low frequency electro-mechanical transducer through an electronic divider. In the art, where watches are driven by tuning forks and other mechanical oscillators, the oscillation of such mechanical oscillators is sustained even if the battery for the driving circuit is temporarily disconnected, as by a shock to the watch case. In other words, mechanical oscillators such as tuning forks have a memory of the time, which permits such constructions to neither lose nor gain time even if the connection to the battery is momentarily opened, as by a shock.

On the other hand, the divider and oscillator circuitry of electronic watches have no such memory, so that when the power supply is cut off, timekeeping by the divider is affected. The arrangement according to the invention teaches an arrangement for protecting electronic watches from such momentary cut-off of the power supply.

SUMMARY OF THE INVENTION

Generally speaking, in accordance with the invention, an electronic watch is provided including a standard oscillator for producing a high frequency signal, an electric divider for dividing said high frequency signal into low frequency timing signals, a battery operatively coupled to said oscillator and divider for driving same, and a capacitor fixedly connected in parallel with said battery for temporarily serving as a voltage source when said battery is momentarily disconnected. Said oscillator may include a quartz crystal, while said electronic divider may be formed from COS MOS transistors. Said electronic divider may be operatively coupled to a pulse motor operating at relatively low frequencies.

Accordingly, it is an object of this invention to provide a stable electronic watch protected against disconnection of the battery due to shock.

Still another object of the invention is to provide a stable electronic watch wherein electronic circuits are formed from COS MOS transistors having low power dissipation characteristics.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
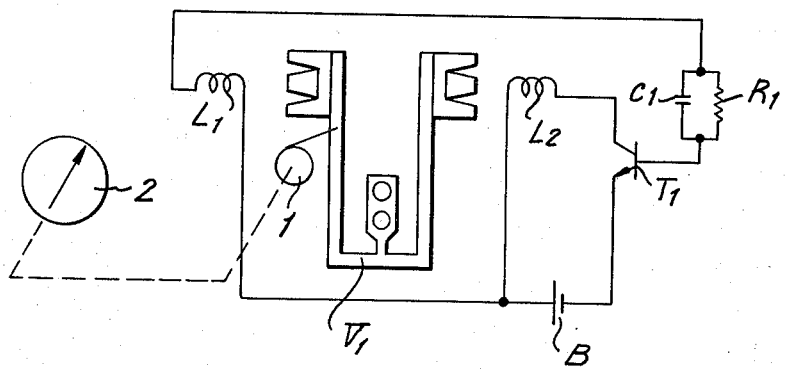
FIG. 1 is a schematic and circuit diagram of a conventional tuning fork type watch.

Referring now to FIG. 1, the prior art tuning-fork watch schematically depicted therein includes a ratchet wheel 1 driven by a tuning fork $V_1$, and which in turn continuously drives a second hand 2. The watch is provided with a sensing coil $L_1$ which detects the vibration of the tuning fork $V_1$, and a driving coil $L_2$ which applies driving force to said tuning fork to sustain the oscillations thereof. The circuit further includes a switching transistor $T_1$ having said driving coil $L_2$ and a battery B in the emitter-collector path thereof. A capacitor $C_1$ is connected in parallel with a biasing resistor $R_1$, said parallel combination being connected in series with the base of transistor $T_1$ and sensing coil $L_1$. Said tuning fork is driven by current supplies from said battery and applied to driving coil $L_2$.

Figure 2:
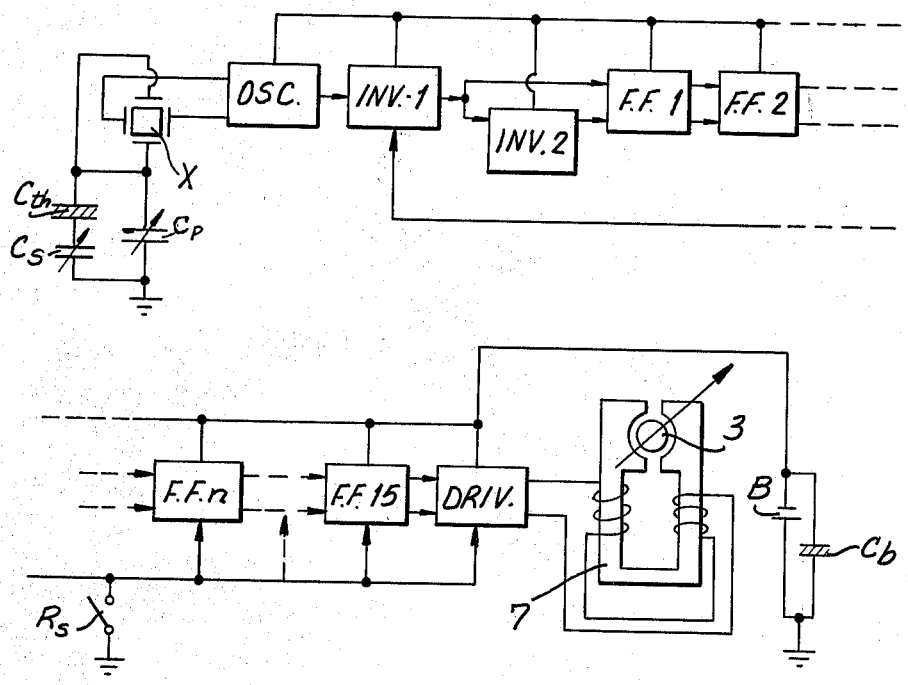
PRIOR ART FIG. 2
FIG. 2 is a schematic and circuit diagram of the electronic watch according to the invention.

As noted above, the arrangement of FIG. 1 will continue to function even if battery B is momentarily disconnected, as by a shock, since the tuning fork $V_1$ will, at least for a short period of time, serve as a self-sustaining oscillator. The electronic watch according to the invention is depicted in FIG. 2, and includes a crystal oscillator X having an oscillation frequency of about 8–33 kHz. Said crystal oscillator consists of a quartz crystal and is coupled to a temperature compensating element $C_{th}$ and variable capacitors $C_s$ and $C_p$. Temperature compensating element $C_{th}$ and variable capacitor $C_p$ compensate for the deviation in frequency according to temperature, while variable capacitor $C_s$ adjusts the frequency of oscillation. The output of the oscillator is amplified and changed into two clock signals which differ in phase by $\pi$ radians by a pair of inverters. The high frequency clock signals are divided into a 1 Hz signal having a period of one second by the binary chain $FF_1, FF_2, \ldots, FF_n, \ldots, FF_{15}$. This binary chain defines an electronic divider circuit preferably formed of COS MOS transistors in an integrated circuit. Such COS MOS transistors are formed from metal-oxide semiconductors arranged in a complimentary-symmetry configuration. The output signal of $FF_{15}$ is applied to a driver DRIV., which in turn drives an electromechanical transducer such as pulse motor 3. A switch $R_s$ is provided for resetting the portion of the binary chain consisting of $FF_n, \ldots, FF_{15}$, for the purpose of adjusting the second hand to standard time. At the same time, switch $R_s$ turns inverter $INV_1$ off to reduce power consumption. Because the quiescent dissipation of COS MOS circuits is nearly equal to zero, the power consumption can be substantially reduced by turning inverter $INV_1$ off.

Figure 3:
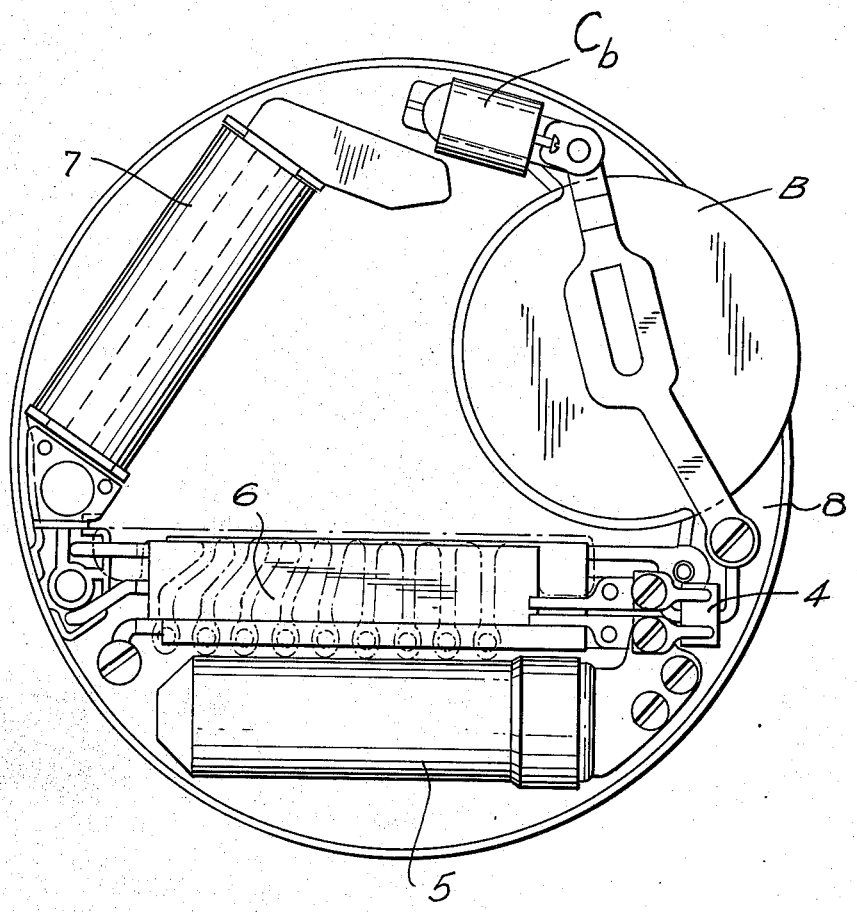
FIG. 3 is a partial top plan view of the electronic watch of FIG. 2.

The electronic circuitry is driven by a button battery B more particularly depicted in FIG. 3 having a capacitor $C_b$ connected in parallel therewith. Capacitor $C_b$ assures the correct operation of the circuitry even though the connections to the battery may be momentarily opened. The stored energy in the capacitor is sufficient to supply the driving voltage to the electronic circuitry on a temporary basis during such momentary disconnection of the battery. Capacitor $C_b$ must be efficient and of a large enough value such as at least 1 $\mu$F, to allow same to properly dissipate the circuitry and drive the pulse motor at peak currents of 300 $\mu$A or greater.

It is noted that merely improving the construction of the holder or connectors to the battery will not overcome the deficiencies cured by capacitor $C_b$. The connection between the battery and the electronic circuitry will never be immune from momentary disconnection due to shock unless said electronic circuitry is welded or soldered directly to the battery. However, batteries having welded connectors are not acceptable in watches and the like where replacement of the battery must be readily achievable.

Referring now to FIG. 3, the physical assembly of the electronic watch according to the invention is depicted. The watch includes a button battery B, the capacitor $C_b$ having a magnitude on the order of at least 1 $\mu$F connected in parallel to battery B, the temperature compensating capacitor 4, the crystal vibrator 5, the frequency adjusting capacitor 6, and the driving coil 7 of the pulse motor. All of said elements are mounted on a base plate 8.

The above-described arrangement is specifically adapted for watches incorporating electronic dividers, and also for watches incorporating electro-optical displays and integrated circuits, said arrangement avoiding deterioration in timekeeping when such watches are subjected to shock.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An electronic watch comprising time standard oscillator means for producing a high frequency signal; electronic divider means coupled to said standard oscillator means for dividing said high frequency signal into low frequency timing signals having a period of one second; driving circuit means operatively coupled to said divider means for receiving said one second timing signals and producing one second motor driving signals; pulse motor means operating at peak currents of at least 300 $\mu$ amps and including driving coil means electrically coupled to said driving circuit means for receiving said motor driving signals; a button battery releasably mounted in said watch and operatively coupled to said oscillator means, divider means and driving circuit means for driving same by applying thereto a substantially constant voltage; and a capacitor having a capacitance of at least 1 $\mu$F fixedly mounted in said watch and connected in parallel with said battery means for serving as a constant voltage source for applying a constant voltage to said oscillator means, divider means, and driving circuit means during momentary disconnections of said battery means.

* * * * *